US009517398B2

(12) United States Patent
Fu et al.

(10) Patent No.: US 9,517,398 B2
(45) Date of Patent: Dec. 13, 2016

(54) EXTRA-LONG AIR-WATER SANDBAG

(71) Applicants: Dickson Fu, Taipei (TW); David Fu, New Taipei (TW)

(72) Inventors: Dickson Fu, Taipei (TW); David Fu, New Taipei (TW)

(73) Assignee: David Fu, New Taipei (TW)

( * ) Notice: Subject to any disclaimer, the term of this patent is extended or adjusted under 35 U.S.C. 154(b) by 86 days.

(21) Appl. No.: 14/168,896

(22) Filed: Jan. 30, 2014

(65) Prior Publication Data

US 2014/0226919 A1 Aug. 14, 2014

(30) Foreign Application Priority Data

Feb. 8, 2013 (TW) ..... 102203103 U

(51) Int. Cl.

*A63B 69/34* (2006.01)
*A63B 69/20* (2006.01)
*A63B 71/02* (2006.01)

(52) U.S. Cl.

CPC ..... *A63B 69/20* (2013.01); *A63B 2071/026* (2013.01); *A63B 2225/62* (2013.01)

(58) Field of Classification Search

CPC ..... A63B 69/20; A63B 69/201; A63B 69/203; A63B 69/205; A63B 69/206; A63B 69/208; A63B 69/24; A63B 69/26; A63B 69/32; A63B 69/325; A63B 69/34; A63B 69/345; A63B 2225/62; A63B 2071/026; A63B 2244/10; A63B 2244/102; A63B 2244/104; A63B 2244/106; A63B 2244/108; A63B 21/0004; A63B 21/00069;A63B 21/00076; A63B 21/008; A63B 21/0084; A63B 21/0085; A63B 21/0088; A63B 21/028; A63B 21/0602

USPC ..... 482/83–90

See application file for complete search history.

(56) References Cited

U.S. PATENT DOCUMENTS 3,748,669 A * 7/1973 Warner ..... A47C 27/085 5/673
4,103,889 A * 8/1978 Lobur ..... A63B 69/201 273/DIG. 20
4,208,048 A * 6/1980 Winterbottom ..... A63B 69/32 482/84
4,527,796 A * 7/1985 Critelli ..... A63B 21/0602 473/442
4,596,106 A * 6/1986 Kunczynski ..... A63B 71/0054 267/116
5,052,683 A * 10/1991 Wang ..... A63B 69/34 273/458

(Continued)

*Primary Examiner* — Loan H Thanh
*Assistant Examiner* — Gary D Urbiel Goldner
(74) *Attorney, Agent, or Firm* — Raymond Y. Chan; David and Raymond Patent Firm

(57) ABSTRACT

An extra-long air-water sandbag includes an inner bladder and an external bag. The external bag is a bag to hold the inner bladder and covers the external of the inner bladder. The inner bladder further includes an inner and outer layer container set which includes a gas container and a liquid container, and an extension layer gas container which is a bladder for containing gas and housed at the top, bottom or top and bottom thereof to increase the total length of space of gas container of the punching bag. As the length of gas container is increased, combat training for the feet is hence achieved.

9 Claims, 8 Drawing Sheets

(56) References Cited

U.S. PATENT DOCUMENTS 5,297,944 A * 3/1994 Pomeroy ..... A47C 27/081 128/205.13
5,437,590 A * 8/1995 D'Alto ..... A63B 69/208 473/441
5,806,768 A * 9/1998 Engel ..... A63H 23/10 239/289
5,941,801 A * 8/1999 D'Alto ..... A63B 69/208 482/83
6,558,298 B2 * 5/2003 Fields ..... A63B 69/201 482/86
6,827,674 B1 * 12/2004 Ferry ..... A63B 69/201 482/83
6,994,658 B2 * 2/2006 Laudenslager ..... A63B 69/201 482/83
7,678,029 B2 * 3/2010 Ng ..... A63B 69/208 482/90
7,758,476 B2 * 7/2010 Chu ..... A63B 69/004 482/83
2002/0086776 A1 * 7/2002 Fields ..... A63B 69/201 482/83
2002/0115538 A1 * 8/2002 Wen ..... A63B 69/34 482/83
2004/0097348 A1 * 5/2004 Laudenslager ..... A63B 69/201 482/86
2005/0192165 A1 * 9/2005 Booker ..... A63B 69/004 482/84
2006/0063653 A1 * 3/2006 Wickens ..... A63B 41/00 482/142
2006/0166793 A1 * 7/2006 Gobel ..... A63B 21/0601 482/87
2007/0099772 A1 * 5/2007 Fu ..... A63B 69/004 482/83
2007/0117658 A1 * 5/2007 Best ..... A63B 69/004 473/415
2008/0096733 A1 * 4/2008 Epstein ..... A63B 69/201 482/83
2008/0125293 A1 * 5/2008 Ng ..... A63B 69/32 482/84
2008/0188360 A1 * 8/2008 Chu ..... A63B 69/004 482/83
2008/0260299 A1 * 10/2008 Ng ..... A63B 69/208 383/3
2009/0188820 A1 * 7/2009 McGrail ..... A63B 55/00 206/315.4
2011/0251024 A1 * 10/2011 Hu ..... A63B 69/20 482/90
2012/0157269 A1 * 6/2012 Fu ..... A63B 69/20 482/86

* cited by examiner

EXTRA-LONG AIR-WATER SANDBAG

BACKGROUND OF THE INVENTION

Field of the Invention

The present invention relates to an extra-long air-water sandbag, particularly one that with inner bladder suitable for both liquid and gas filler and that the space of total gas container is larger than that of total liquid container.

Description of Prior Arts

Conventional inner bladder is a closed bladder using solid (such as sand), liquid (such as water), or gas (such as air) as filler and placed inside one external bag.

It is easy and cheap to obtain said filler; however, the weight of punching bag impacts the training effect. When solid is used as filler in inner bladder, the weight of punching bag is heavy and cannot be easily moved and storage would be difficult. When liquid is solely used as filler in inner bladder, the heavy weight of punching bag would result in poor training effect. When gas is used as filler in inner bladder, the punching bag is generally too light in weight and requires other materials to fix it in place, thus result in poor training effect.

In addition, for conventional punching bag structure, be it adopting solid, liquid, or gas as filler, there is only one tactile feel. When filling with solids, punching bag gives a firm texture while filling liquids adds few softness and resilience. When filling with gas, punching gas is even more resilient. However, none of the foregoing fillers may be adjusted in the very same structure to create different texture to satisfy user's different training demand.

In addition, conventional punching bag is only for combat training of hands and cannot train for feet combats. If the punching bag is to be used for both hand and feet combat trainings, the length of said inner bladder should be extended. In order to do that, the weight of the said inner bladder is increased and therefore shortening the life of the inner bladder structure.

Thus, there are foregoing drawbacks of conventional elastic structure of physical training device in prior art to be improved.

SUMMARY OF THE INVENTION

To overcome the existing problems of prior art, present invention provides an extra-long air-water sandbag that can be used for both hand and feet combat training; and the weight of inner bladder can be adjusted for better combat training effect.

The present invention discloses an extra-long air-water sandbag that comprises one inner bladder and one external bag.

Wherein, said external bag is the bag to hold the said inner bladder and covers the external of the said inner bladder. The said inner bladder further comprises one inner and outer layer container set and at least one separation layer gas container. The said separation layer gas container is a bladder for containing gas and housed at the top, bottom or top and bottom of the said inner and outer layer container set and fixedly connect or couple to the top, bottom or top and bottom of the said inner and outer layer container set to increase the total length of space of gas container of the punching bag. As the length of gas container is increased, combat training for the feet can be hence achieved. The inner and outer layer container set further comprises one gas container and one liquid container. The said gas container is a bladder for gas storage placed in inner compartment of said inner and outer layer container set. The said liquid container is a bladder for liquid storage placed in outer compartment of said gas container. Or, the said gas container is a bladder for gas storage placed in outer compartment of said inner and outer layer container set; and the said liquid container is a bladder for liquid storage placed in inner compartment of said gas container.

Preferably, said external bag has one waterproof layer housed on the inner side and coupled to the top of the said external bag to prevent liquid or colloid contained in the said liquid container from outflow to outside of the sandbag due to breakage. The said external bag has one cover located on top of the said external bag and bounded to the top of said external bag to protect the inner bladder and extend its life. Said gas container comprises at least one air valve set installed on one end of said gas container and connects to interior of said gas container. The said air valve set is used to change the pressure inside the said gas container to further adjust the volume of said liquid container. Or the said gas container may equip with at least one air-vent on one end of said gas container and connects to interior of said separation layer gas container. The said air-vent is used to allow air circulation between the said separation layer gas container and said gas container. Or the said gas container may equip at least one air valve set and at least one air-vent. The said air valve set is installed on one end of said gas container and connects to interior of the said gas container to change the pressure inside the gas container. The air-vent is located on the other end of the said gas container and connects to the interior of the said separation layer gas container so air circulation is allowed between the said gas container and said separation layer gas container. The said separation layer gas container may equip with at least one air valve set on one end of the said separation layer gas container and connects to the interior of said separation layer gas container to change the pressure inside said separation layer gas container. Said air valve is selected from either inflation valve for balls or air bed valve. The said liquid container has at least one water inlet set located on the side or top of the said liquid container and connects to the interior of said liquid container for injecting liquid or colloid to adjust the weight of said inner bladder. As the weight of inner bladder is adjusted, different user demand can be reached for better combat training effect.

Aside from foregoing formation and function of the extra-long air-water sandbag described above, said liquid container comprises additionally at least one valve set installed on top end or top-sided of said liquid container and connects to interior of said liquid container. Firmness of said inner bladder can be adjusted by air inflation or exhaustion via said valve set, and thus to adjust punching texture. Moreover, said inner bladder additionally comprises one fixed-shape ring on top part of said inner bladder and fixed on said liquid container to shape the top of said liquid container as to avoid damage from collapses and wrinkles created due to insufficient pressure on top of said liquid container. The fixed-shape ring also serves to make the liquid container more artistic. The said inner bladder further comprises at least one pad housed between the said inner and outer layer container set and said separation layer gas container. The said pad can fill the space between external side of said inner and outer layer container set 11 and said external bag.

DETAILED DESCRIPTION OF THE PREFERRED EMBODIMENTS

The presently preferred embodiment and related aspects of the invention will now be described with reference to the accompanied drawings.

Figure 1:
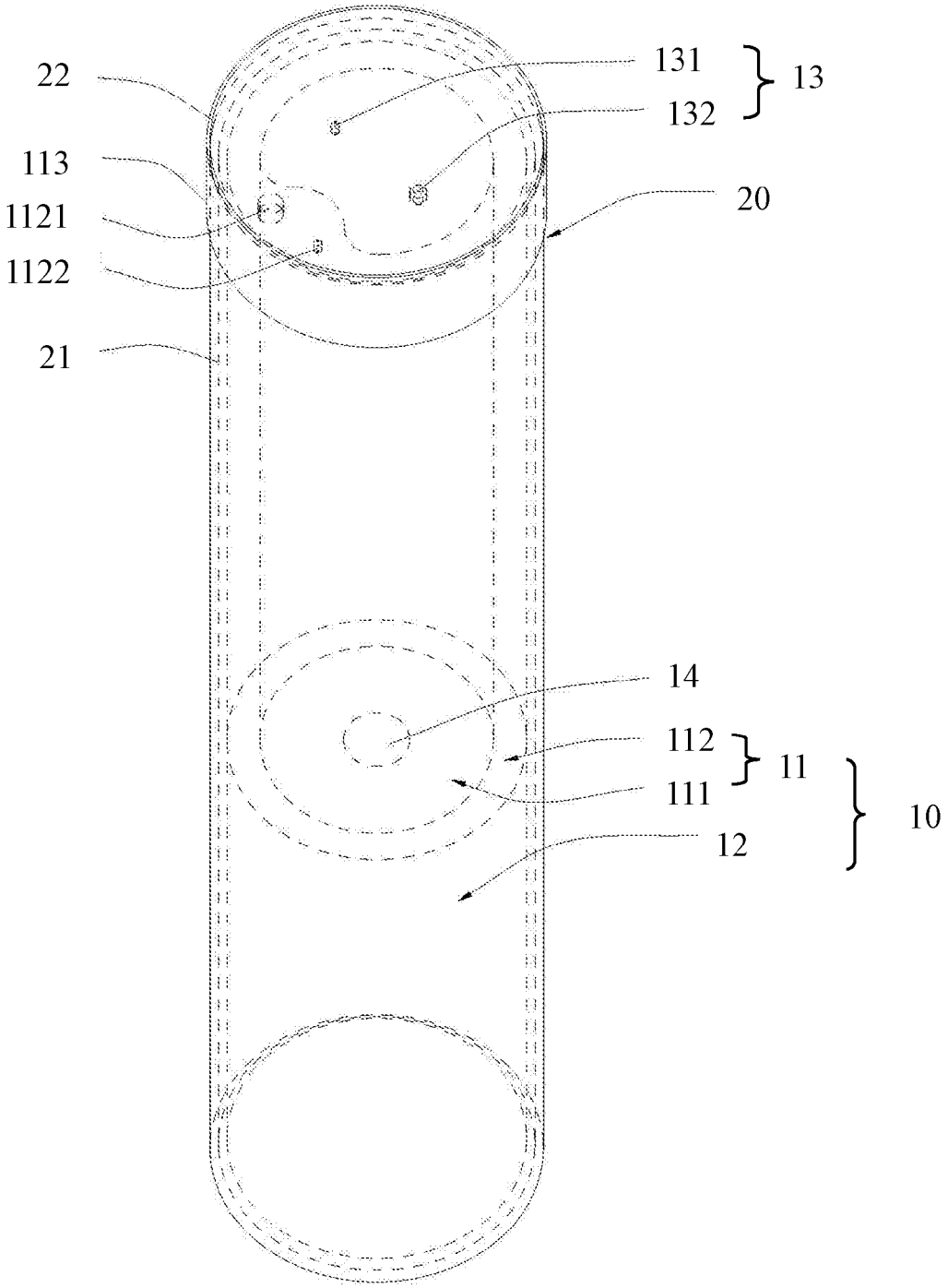
FIG. 1 is a three-dimensional view of embodiment A of present invention.
Figure 2:
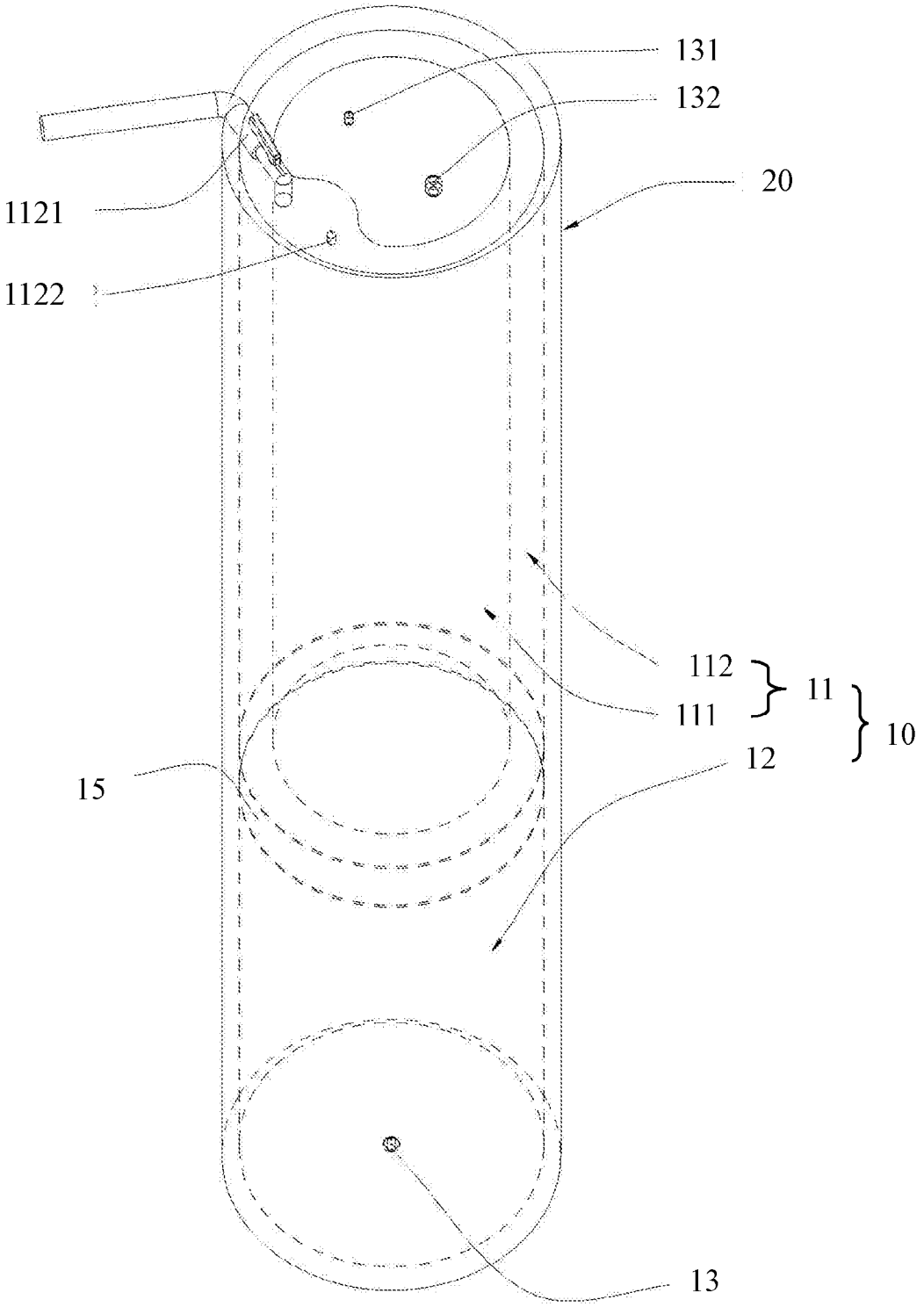
FIG. 2 is a three-dimensional view of embodiment B of present invention.
Figure 7:
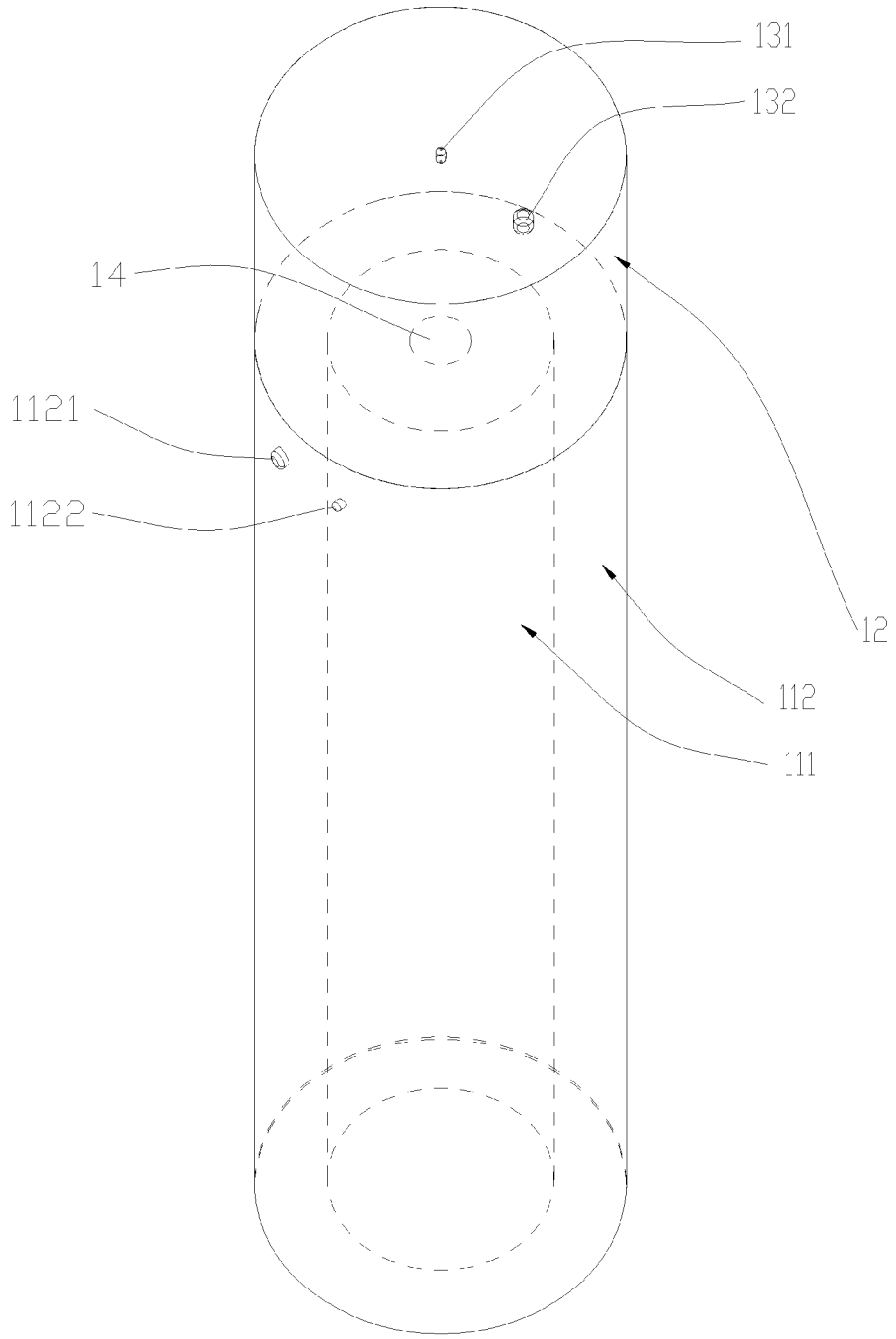
FIG. 7 is a three-dimensional view of the inner bladder of embodiment G of present invention
Figure 8:
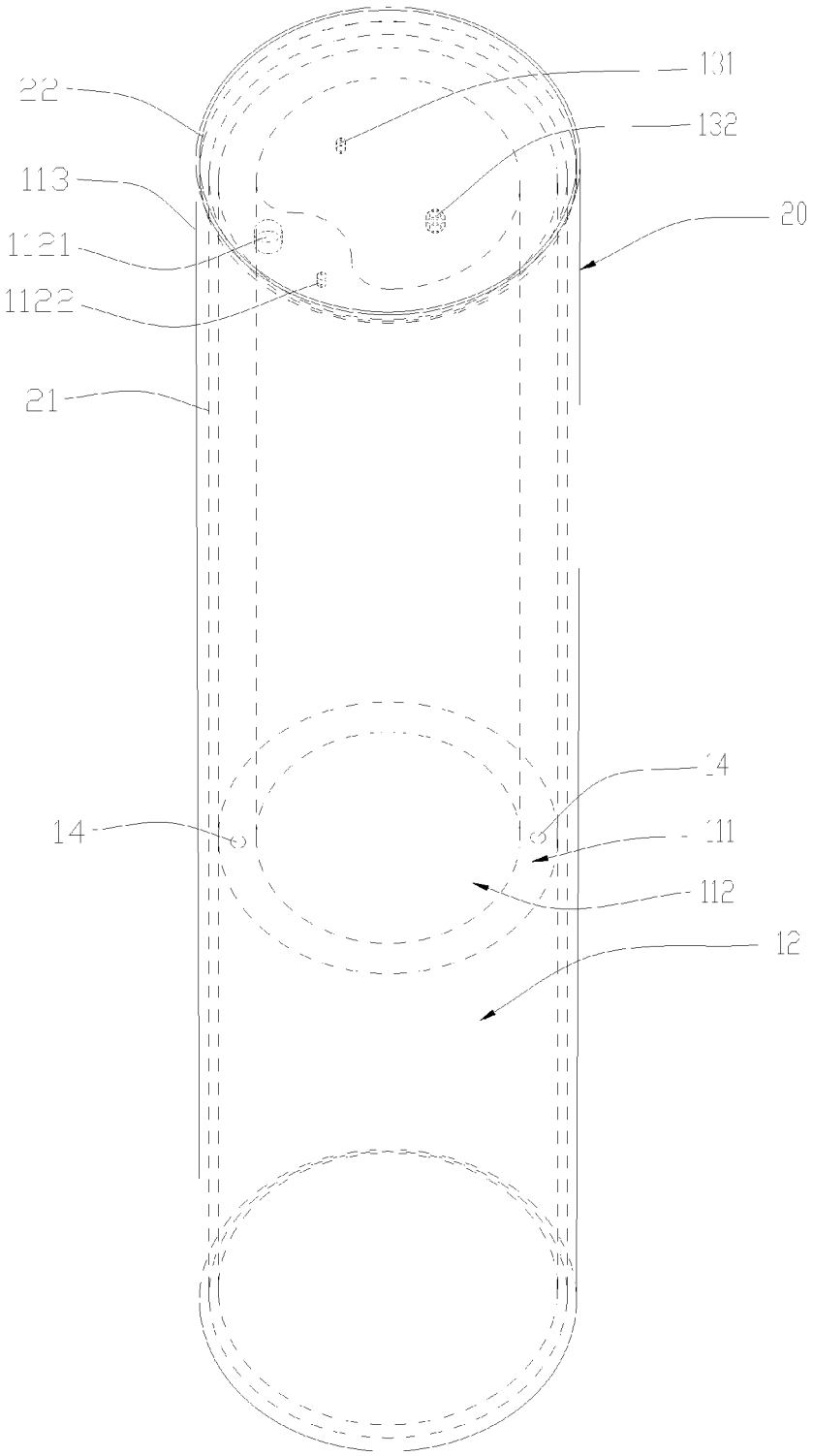
FIG. 8 is a three-dimensional view of embodiment H of present invention.

Please refer to FIGS. 1, 2, and 8 for the three-dimensional views of different embodiments of the present invention. Please refer to FIGS. 3, 4, 5, 6, and 7 for the three-dimensional views of inner bladder of different embodiments of the present invention; wherein said invention comprise one inner bladder 10 and one external bag 20.

Wherein, said external bag 20 is the bag to hold the said inner bladder 10 and covers the external of the said inner bladder 10. The said inner bladder 10 further comprises one inner and outer layer container set 11 and at least one extension layer gas container 12. The said inner and outer layer container set 11 further comprises one gas container 111 and one liquid container 112. The said gas container 111 is a bladder for gas storage. The said liquid container 112 is a bladder for liquid or colloid storage. The said extension layer gas container 12 is a bladder for gas storage.

As shown in FIG. 1, said external bag 20 has one waterproof layer 21 housed on the inner side and coupled to the top of the said external bag 20. The said external bag 20 has one cover 22 located on top of the said external bag 20 and bounded to the top of said external bag 20. Said gas container 111 located on the inner layer of said inner and outer layer container set 11; said liquid container 112 located on the external side of said gas container 11. The said separation layer gas container 12 located on the bottom of said inner and outer layer container set 11 and fixed on the bottom of said inner and outer layer container set 11. Said gas container 111 comprises at least one air valve set 13 installed on one end of said gas container 111 and connects to interior of said gas container 111. Said air valve set 13 is either inflation valve for balls 131 or air bed valve 132. Said gas container 111 equips with at least one air-vent 14 on the bottom of said gas container 111 and connects to interior of said extension layer gas container 12. The said liquid container 112 has at least one water inlet set 1121 with water plug located on the top of said liquid container 112 and connects to the interior of said liquid container 112. Said liquid container 112 has at least one air valve set 1122 on the top of said liquid container 112 and connects to the interior of said liquid container 112. Said inner and outer layer container set 11 has one fixed-shape ring 113 located on the top compartment of said inner and outer layer container set 11 and connects to the said liquid container 112.

First inject air into said gas container 111 via air valve set 13; and air will be filled into the said extension layer gas container 12 via the said air-vent 14. Volume of said gas container 111 will increase due to pressure increase inside said gas container 111 and then volume of said liquid container 112 will be reduced.

Open said water inlet set 1121 to allow user to add certain amount of liquid or colloid into said liquid container 112 in accordance with user's demand. Meanwhile, on top of liquid or colloid inside said liquid container 112 is filled with air.

Finally, close said water inlet set 1121 and open said valve set 1122 to inject air into gas container 111 via said air valve set 13; and air will be filled into the said extension layer gas container 12 via the said air-vent 14. Volume of said gas container 111 will expand due to increase of pressure and compress volume of said liquid container 112. The level of liquid or colloid inside said liquid container 112 will rise due to compression and air inside said liquid container 112 will be exhausted via said valve set 1122 until liquid or colloid drained out of said liquid container 112 via said valve set 1122, meaning air inside liquid container 112 is completed exhausted. Meanwhile, stop injecting air into gas container 111 via said air valve set 13 and close said valve set 1122 to completely seal said liquid container 112. Then cover the external bag 20 on the external side of said inner bladder 10.

Said liquid container 112 is completely filled with demanded amount of liquid or colloid in accordance with user's training need to obtain desired texture of punching at practice. Liquid or colloid and air inside said inner bladder 10 all can be exhausted via said water inlet set 1121 and air valve set 13 thus said inner bladder 10 is easier to be stored and moved.

If firmness of said inner bladder 10 is desired to be increased, air can be injected into said liquid container 112 via said valve set 1122.

As shown in FIG. 2, said gas container 111 located on the inner layer of said inner and outer layer container set 11; said liquid container 112 located on the external side of said gas container 11. The said extension layer gas container 12 located on the bottom of said inner and outer layer container set 11 and fixed on the bottom of said inner and outer layer container set 11. Place one pad 15 between bottom of said inner and outer layer container set 11 and said extension layer gas container 12. Said pad 15 can fill the space between external side of bottom of said inner and outer layer container set 11 and said external bag 20. Said gas container 111 comprises at least one air valve set 13 installed on one end of said gas container 111 and connects to interior of said gas container 111. Said air valve set 13 is either inflation valve for balls 131 or air bed valve 132. The said liquid container 112 has at least one water inlet set 1121 with water valve located on the top of said liquid container 112 and connects to the interior of said liquid container 112. Said liquid container 112 has at least one air valve set 1122 on the top of said liquid container 112 and connects to the interior of said liquid container 112. Said extension layer gas container 12 has at least one air valve set 13 located on one end of said separation layer gas container 12 and connects to the said liquid container 112.

First inject air into said extension layer gas container 12 via air valve set 13 of said extension layer gas container 12. Pressure inside said extension layer gas container 12 will increase to meet the training needs. In addition, inject air into said gas container 111 via air valve set 13. Volume of said gas container 111 will increase due to pressure increase inside said gas container 111 and then volume of said liquid container 112 will be reduced.

Open said water inlet set 1121 to allow user to add certain amount of liquid or colloid into said liquid container 112 in accordance with user's demand. Meanwhile, on top of liquid or colloid inside said liquid container 112 is filled with air.

Finally, close said water inlet set 1121 and open said valve set 1122 to inject air into gas container 111 via said air valve set 13. Volume of said gas container 111 will expand due to increase of pressure and compress volume of said liquid container 112. The level of liquid or colloid inside said liquid container 112 will rise due to compression and air inside said liquid container 112 will be exhausted via said valve set 1122 until liquid or colloid drained out of said liquid container 112 via said valve set 1122, meaning air inside liquid container 112 is completed exhausted. Meanwhile, stop injecting air into gas container 111 via said air valve set 13 and close said valve set 1122 to completely seal said liquid container 112. Then cover the external bag 20 on the external side of said inner bladder 10.

Said liquid container 112 is completely filled with demanded amount of liquid or colloid in accordance with user's training need to obtain desired texture of punching at practice. Liquid or colloid and air inside said inner bladder 10 all can be exhausted via said water inlet set 1121 and air valve set 13 thus said inner bladder 10 is easier to be stored and moved.

If firmness of said inner bladder 10 is desired to be increased, air can be injected into said liquid container 112 via said valve set 1122.

Figure 3:
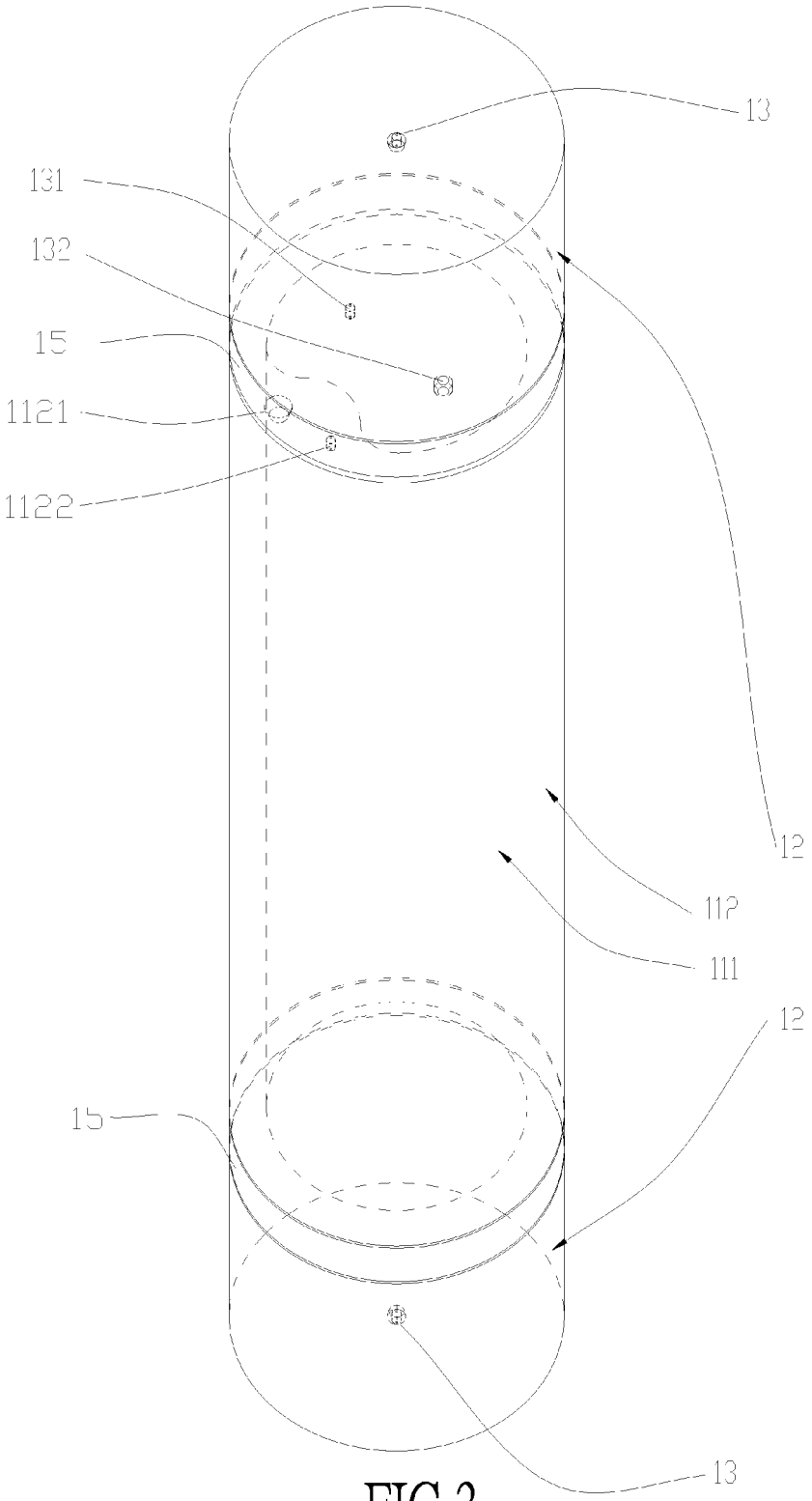
FIG. 3 is a three-dimensional view of the inner bladder of embodiment C of present invention.

As shown in FIG. 3, add another said extension layer gas container 12 on top of the said inner and outer layer container set 11. Place another said pad 15 between top of said inner and outer layer container set 11 and said another extension layer gas container 12. Said pad 15 can fill the space between external side of top of said inner and outer layer container set 11 and said external bag 20. Said water inlet set 1121 has concave water plug located on the top of said liquid container 112 and connects to the interior of said liquid container 112. The rest are the same as in FIG. 2.

Figure 4:
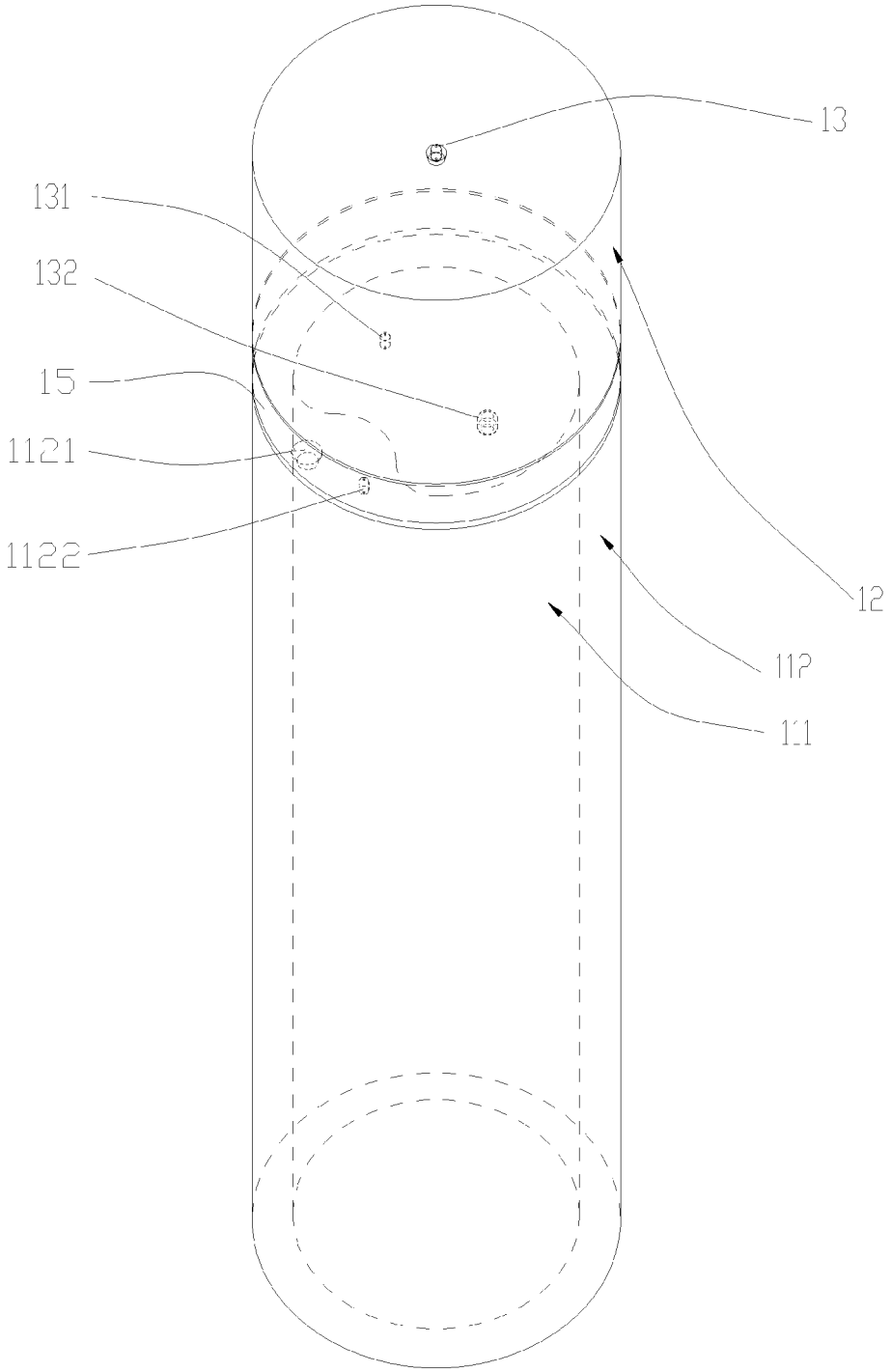
FIG. 4 is a three-dimensional view of the inner bladder of embodiment D of present invention.

As shown in FIG. 4, remove the said extension layer gas container 12 and said pad 15 located on bottom of said inner and outer layer container set 11. The rest are the same as in FIG. 3.

Figure 5:
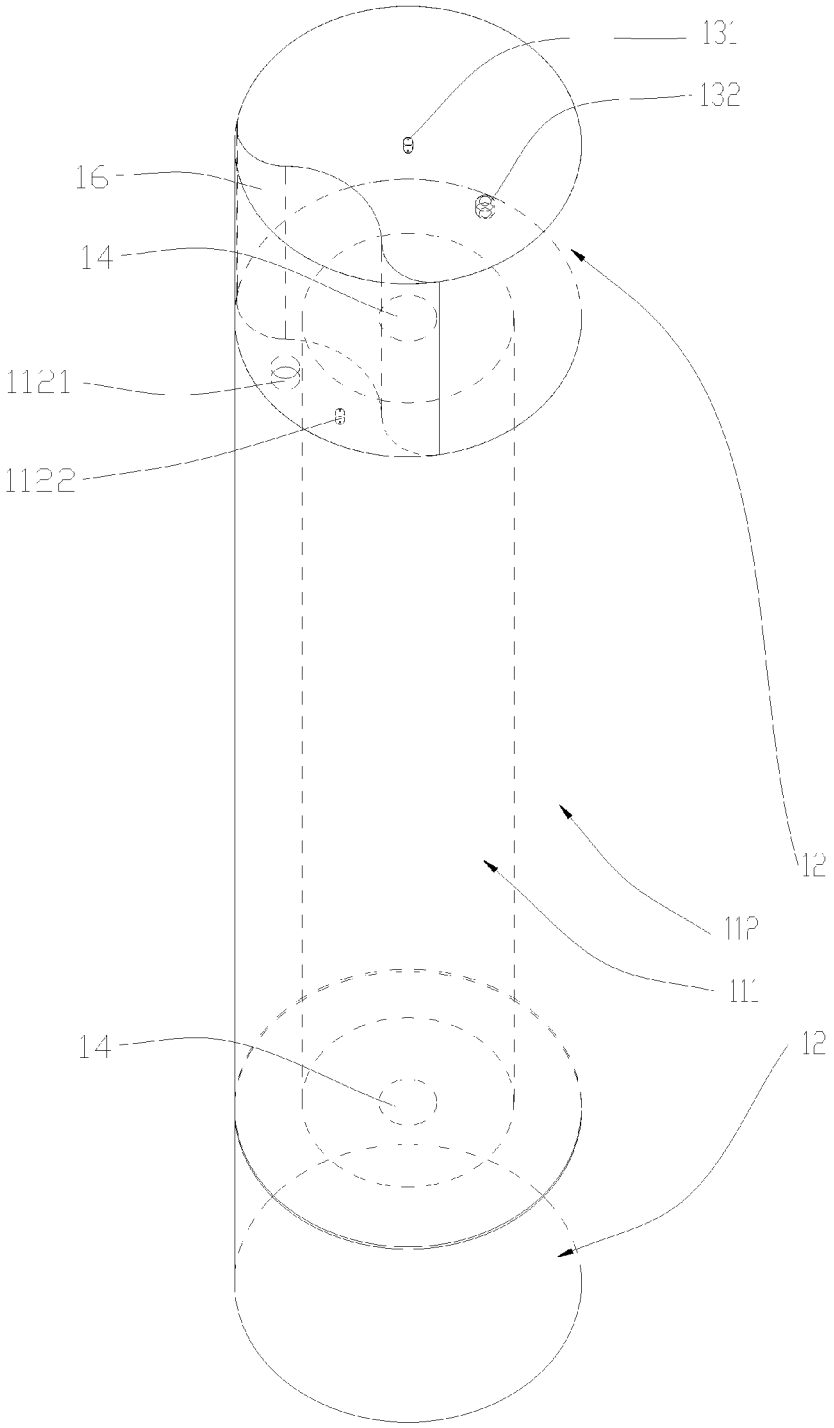
FIG. 5 is a three-dimensional view of the inner bladder of embodiment E of present invention.

As shown in FIG. 5, said gas container 111 located on the inner layer of said inner and outer layer container set 11; said liquid container 112 located on the external side of said gas container 11. The said separation layer gas container 12 located on the top and bottom of said inner and outer layer container set 11 and fixed on the top and bottom of said inner and outer layer container set 11. Said extension layer gas container 12 has at least one air valve set 13 located on one end of said extension layer gas container 12 and connects to the said liquid container 112. Said air valve set 13 is either inflation valve for balls 131 or air bed valve 132. Said gas container 111 has multiple air-vents 14 on the top and bottom of said gas container 111 and connects to interior of said extension layer gas container 12. Said liquid container 112 has at least one water inlet set 1121 with water plug located on the top of said liquid container 112 and connects to the interior of said liquid container 112. Said liquid container 112 has at least one air valve set 1122 on the top of said liquid container 112 and connects to the interior of said liquid container 112.

First inject air into said extension layer gas container 12 via air valve set 13; and air will be filled into the said gas container 111 and said another extension layer gas container 12 via the said air-vent 14. Volume of said gas container 111 will increase due to pressure increase inside said gas container 111 and then volume of said liquid container 112 will be reduced.

Open said water inlet set 1121 to allow user to add certain amount of liquid or colloid into said liquid container 112 in accordance with user's demand. Meanwhile, on top of liquid or colloid inside said liquid container 112 is filled with air.

Finally, close said water inlet set 1121 and open said valve set 1122 to inject air into said extension layer gas container 12 via said air valve set 13; and air will be filled into the said air container 111 and another said extension layer gas container 12 via the said air-vent 14. Volume of said gas container 111 will expand due to increase of pressure and compress volume of said liquid container 112. The level of liquid or colloid inside said liquid container 112 will rise due to compression and air inside said liquid container 112 will be exhausted via said valve set 1122 until liquid or colloid drained out of said liquid container 112 via said valve set 1122, meaning air inside liquid container 112 is completed exhausted. Meanwhile, stop injecting air into said extension layer gas container 12 and said gas container 111 via said air valve set 13 and close said valve set 1122 to completely seal said liquid container 112. Insert one filler part 16. The said filler part 16 is positioned on one side of the said extension layer gas container 12 to make the said extension layer gas container 12 fit more closely to the said external bag 20. Then place the said inner bladder 10 upright and cover the external bag 20 on the external side of said inner bladder 10.

Said liquid container 112 is completely filled with demanded amount of liquid or colloid in accordance with user's training need to obtain desired texture of punching at practice. Liquid or colloid and air inside said inner bladder 10 all can be exhausted via said water inlet set 1121 and air valve set 13 thus said inner bladder 10 is easier to be stored and moved.

If firmness of said inner bladder 10 is desired to be increased, air can be injected into said liquid container 112 via said valve set 1122.

Figure 6:
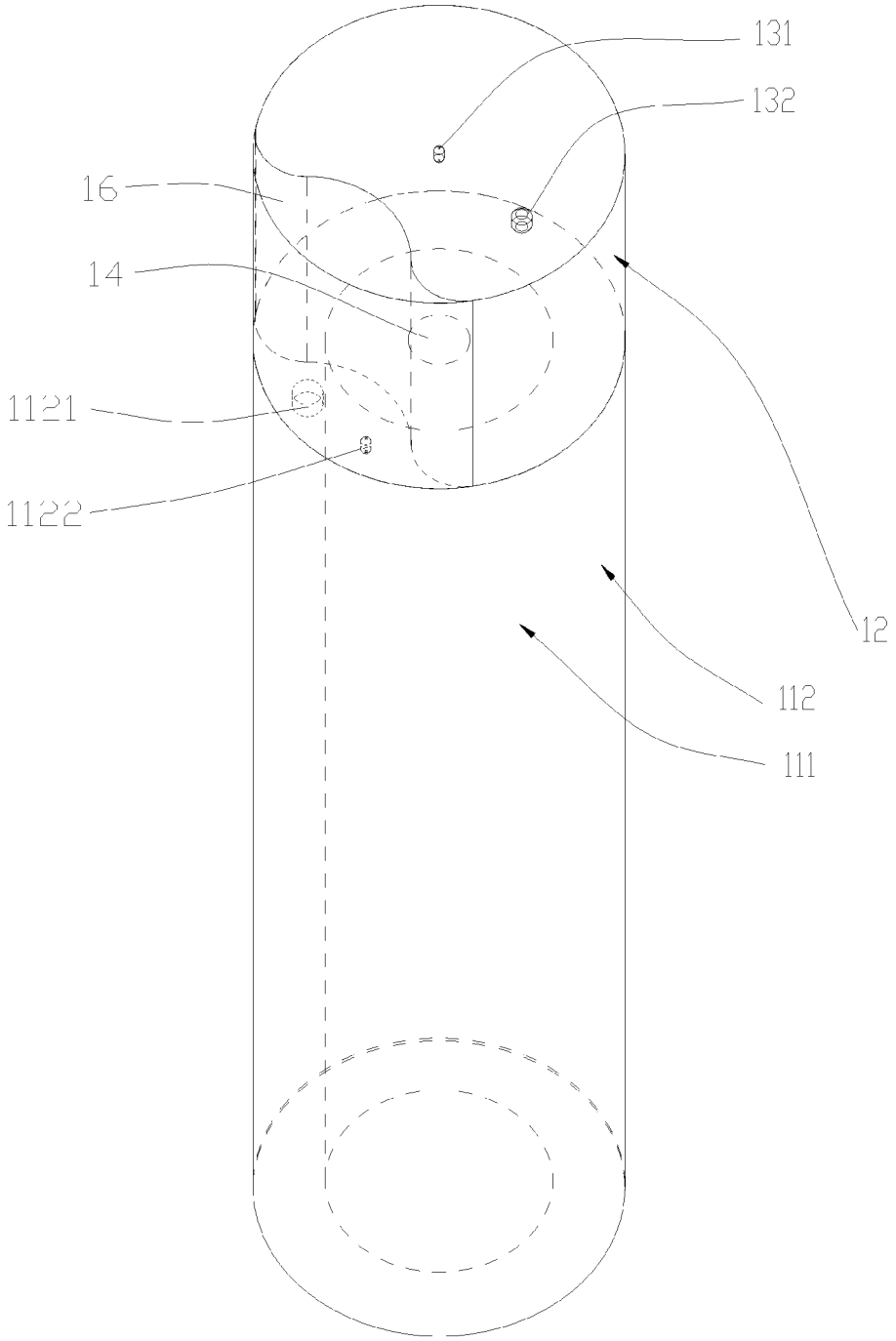
FIG. 6 is a three-dimensional view of the inner bladder of embodiment F of present invention.

As shown in FIG. 6, the said extension layer gas container 12 is one that located on top of the said inner and outer layer container set 11. Said gas container 111 has at least one air-vent 14 located on top of the said gas container 111 and connects to the interior of said extension layer gas container 12. The rest are the same as in FIG. 5.

As shown in FIG. 7, Said gas container 111 located on the inner layer of said inner and outer layer container set 11; said liquid container 112 located on the external side of said gas container 11. The said extension layer gas container 12 located on the top of said inner and outer layer container set 11 and fixed on the top of said inner and outer layer container set 11. Said extension layer gas container 12 comprises at least one air valve set 13 installed on the top of said extension layer gas container 12 and connects to interior of said extension layer gas container 12. Said air valve set 13 is either inflation valve for balls 131 or air bed valve 132. Said gas container 111 equips with at least one air-vent 14 on the top of said gas container 111 and connects to interior of said extension layer gas container 12. The said liquid container 112 has at least one water inlet set 1121 with water plug located on the side of said liquid container 112 and connects to the interior of said liquid container 112. Said liquid container 112 has at least one air valve set 1122 on the side of said liquid container 112 and connects to the interior of said liquid container 112.

First inject air into said extension layer gas container 12 via air valve set 13; and air will be filled into the said gas container 111 via the said air-vent 14. Volume of said gas container 111 will increase due to pressure increase inside said gas container 111 and then volume of said liquid container 112 will be reduced.

Then, place said inner bladder 10 horizontally. Said water inlet set 1121 and said air valve set 1122 face upward. Open said water inlet set 1121 to allow user to add certain amount of liquid or colloid into said liquid container 112 in accordance with user's demand. Meanwhile, on top of liquid or colloid inside said liquid container 112 is filled with air.

Finally, close said water inlet set 1121 and open said valve set 1122 to inject air into said extension layer gas container 12 via said air valve set 13; and air will be filled into the said air container 111 via the said air-vent 14. Volume of said gas container 111 will expand due to increase of pressure and compress volume of said liquid container 112. The level of liquid or colloid inside said liquid container 112 will rise due to compression and air inside said liquid container 112 will be exhausted via said valve set 1122 until liquid or colloid drained out of said liquid container 112 via said valve set 1122, meaning air inside liquid container 112 is completed exhausted. Meanwhile, stop injecting air into said extension layer gas container 12 and said gas container 111 via said air valve set 13 and close said valve set 1122 to completely seal said liquid container 112. Then place the said inner bladder 10 upright and cover the external bag 20 on the external side of said inner bladder 10.

Said liquid container 112 is completely filled with demanded amount of liquid or colloid in accordance with user's training need to obtain desired texture of punching at practice. Liquid or colloid and air inside said inner bladder 10 all can be exhausted via said water inlet set 1121 and air valve set 13 thus said inner bladder 10 is easier to be stored and moved.

If firmness of said inner bladder 10 is desired to be increased, air can be injected into said liquid container 112 via said valve set 1122.

As shown in FIG. 8, said external bag 20 has one waterproof layer 21 housed on the inner side and coupled to the top of the said external bag 20. Said external bag 20 has one cover 22 located on top of the said external bag 20 and bounded to the top of said external bag 20. Said gas container 111 located on the outer layer of said inner and outer layer container set 11; said liquid container 112 located on the inner side of said gas container 11. The said extension layer gas container 12 located on the bottom of said inner and outer layer container set 11 and fixed on the bottom of said inner and outer layer container set 11. Said gas container 111 comprises at least one air valve set 13 installed on one end of said gas container 111 and connects to interior of said gas container 111. Said air valve set 13 is either inflation valve for balls 131 or air bed valve 132. Said gas container 111 equips with at least one air-vent 14 on the bottom of said gas container 111 and connects to interior of said extension layer gas container 12. The said liquid container 112 has at least one water inlet set 1121 with water plug located on the top of said liquid container 112 and connects to the interior of said liquid container 112.

First inject air into said gas container 111 via air valve set 13; and air will be filled into the said extension layer gas container 12 via the said air-vent 14. Volume of said gas container 111 will increase due to pressure increase inside said gas container 111 and then volume of said liquid container 112 will be reduced.

Open said water inlet set 1121 to allow user to add certain amount of liquid or colloid into said liquid container 112 in accordance with user's demand. Meanwhile, on top of liquid or colloid inside said liquid container 112 is filled with air.

Finally, close said water inlet set 1121 and seal the said liquid container 112. Inject air into gas container 111 via said air valve set 13; and air will be filled into the said extension layer gas container 12 via the said air-vent 14. Volume of said gas container 111 will expand due to increase of pressure and compress volume of said liquid container 112. The level of liquid or colloid inside said liquid container 112 will rise due to compression and pressure increases when the air inside said liquid container 12 is compressed. Meanwhile, stop injecting air into gas container 111 via said air valve set 13 and close said valve set 1122 to completely seal said liquid container 112. Then cover the external bag 20 on the external side of said inner bladder 10.

Said liquid container 112 is completely filled with demanded amount of liquid or colloid in accordance with user's training need to obtain desired texture of punching at practice. Liquid or colloid and air inside said inner bladder 10 all can be exhausted via said water inlet set 1121 and air valve set 13 thus said inner bladder 10 is easier to be stored and moved.

Although the present invention has been explained in relation to its preferred embodiment, it is to be understood that many other possible modifications and variations can be made without departing from the scope of the invention as hereinafter claimed.

What is claimed is:

1. An extra-long air-water sandbag, which comprises:

one inner bladder and one external bag; wherein said external bag covers an exterior of said inner bladder, and is configured to hold said inner bladder; wherein said inner bladder comprises: one inner and outer layer container set and at least one extension layer gas container; wherein said at least one extension layer gas container is fixedly connected to said inner and outer layer container set, and is configured for gas storage; wherein said inner and outer layer container set comprises: one gas container and one liquid container; wherein said gas container is placed in an inner compartment of said inner and outer layer container set, and configured for gas storage; and wherein said liquid container is placed in an outer compartment of said gas container, and configured for liquid or colloid storage, wherein said at least one extension layer gas container is arranged with said gas container in an end-to-end manner to increase a total length of said gas container and said at least one extension layer gas container, wherein a volume of said gas container and a volume of said liquid container are individually adjusted and a relative volume ratio between said gas container and said liquid container is correspondingly adjusted to selectively adjust a firmness of said inner bladder.

2. The extra-long air-water sandbag as claimed in claim 1, wherein said external bag has one waterproof layer housed on an inner side of said external bag and coupled to a top of said external bag.

3. The extra-long air-water sandbag as claimed in claim 1, wherein said external bag has one cover located on a top of said external bag and bounded to the top of said external bag.

4. The extra-long air-water sandbag as claimed in claim 1, wherein said gas container comprises at least one air valve set installed on one end of said gas container and connects to an interior of said gas container.

5. The extra-long air-water sandbag as claimed in claim 4, wherein said gas container comprises at least one air vent on one end of said gas container and longitudinally connects to an interior of said at least one extension layer gas container.

6. The extra-long air-water sandbag as claimed in claim 1, wherein said liquid container has at least one water inlet set located on a side or a top of said liquid container and connects to an interior of said liquid container.

7. The extra-long air-water sandbag as claimed in claim 6, wherein said liquid container further comprises at least one valve set installed on one of the side and the top of said liquid container and connects to the interior of said liquid container, wherein the at least one valve set releases air in said liquid container when the liquid or colloid is filled thereinto until said liquid container is fully filled with the liquid or colloid.

8. The extra-long air-water sandbag as claimed in claim 1, wherein said inner and outer layer container set further comprises one fixed-shape ring on a top part of said inner and outer layer container set and fixed on said liquid container.

9. The extra-long air-water sandbag as claimed in claim 1, wherein said inner bladder further comprises at least one pad housed between said inner and outer layer container set and said at least one extension layer gas container.

* * * * *